US008820667B2

(12) United States Patent
Heinrichsmeier et al.

(10) Patent No.: US 8,820,667 B2
(45) Date of Patent: Sep. 2, 2014

(54) SIEVE MILL WITH IMPROVED SIEVE RETAINING PROPERTIES

(75) Inventors: Leonhard Heinrichsmeier, Talheim (DE); Claus Eberhardt, Schwaigern (DE); Claus Ulrich, Obersulm-Suelzbach (DE)

(73) Assignee: Hosokawa Alpine Aktiengesellschaft, Augsburg (DE)

( * ) Notice: Subject to any disclaimer, the term of this patent is extended or adjusted under 35 U.S.C. 154(b) by 185 days.

(21) Appl. No.: 13/643,409

(22) PCT Filed: Apr. 20, 2011

(86) PCT No.: PCT/EP2011/002024

§ 371 (c)(1),
(2), (4) Date: Nov. 28, 2012

(87) PCT Pub. No.: WO2011/134624

PCT Pub. Date: Mar. 11, 2011

(65) Prior Publication Data

US 2013/0206880 A1 Aug. 15, 2013

(30) Foreign Application Priority Data

Apr. 27, 2010 (DE) ..... 10 2010 018 419

(51) Int. Cl.
*B02C 23/16* (2006.01)
*B02C 13/284* (2006.01)
*B02C 18/16* (2006.01)

(52) U.S. Cl.
CPC ..... *B02C 13/284* (2013.01); *B02C 2023/165* (2013.01); *B02C 18/16* (2013.01)
USPC ..... 241/73; 241/285.2

(58) Field of Classification Search
USPC ..... 241/73, 285.2, 186.2, 189.1, 242
See application file for complete search history.

(56) References Cited

U.S. PATENT DOCUMENTS 3,083,746 A * 4/1963 Fenton ..... 241/73
3,756,519 A 9/1973 Reynolds et al.

(Continued)

FOREIGN PATENT DOCUMENTS

CH 567 883 A5 10/1975
DE 3145443 A1 10/1982

(Continued)

OTHER PUBLICATIONS

International Search Report for corresponding application No. PCT/EP2011/002024 mailed Mar. 12, 2012.

*Primary Examiner* — Mark Rosenbaum
(74) *Attorney, Agent, or Firm* — Carter DeLuca Farrell & Schmidt LLP

(57) ABSTRACT

The disclosure relates to a sieve mill including a basket having a curved inner side for supporting a sieve which rests on the curved inner side of the sieve basket, and two longitudinal edges which are parallel and opposite each other, a material inlet arranged above the sieve and a cylindrical rotor arranged such that it can rotate inside the sieve basket. A longitudinal edge of the sieve is arranged in a first retaining bar having a first positioning recess for receiving the longitudinal edge, and another longitudinal edge is arranged in a second retaining bar having a second positioning recess for receiving the other longitudinal edge, the second retaining bar can pivot between an open position in which the second positioning recess can withdraw and feed the associated longitudinal edge, and a closed position in which the second positioning recess exerts pressure upon the longitudinal edge.

10 Claims, 2 Drawing Sheets

(56) References Cited

U.S. PATENT DOCUMENTS

Figure 1:
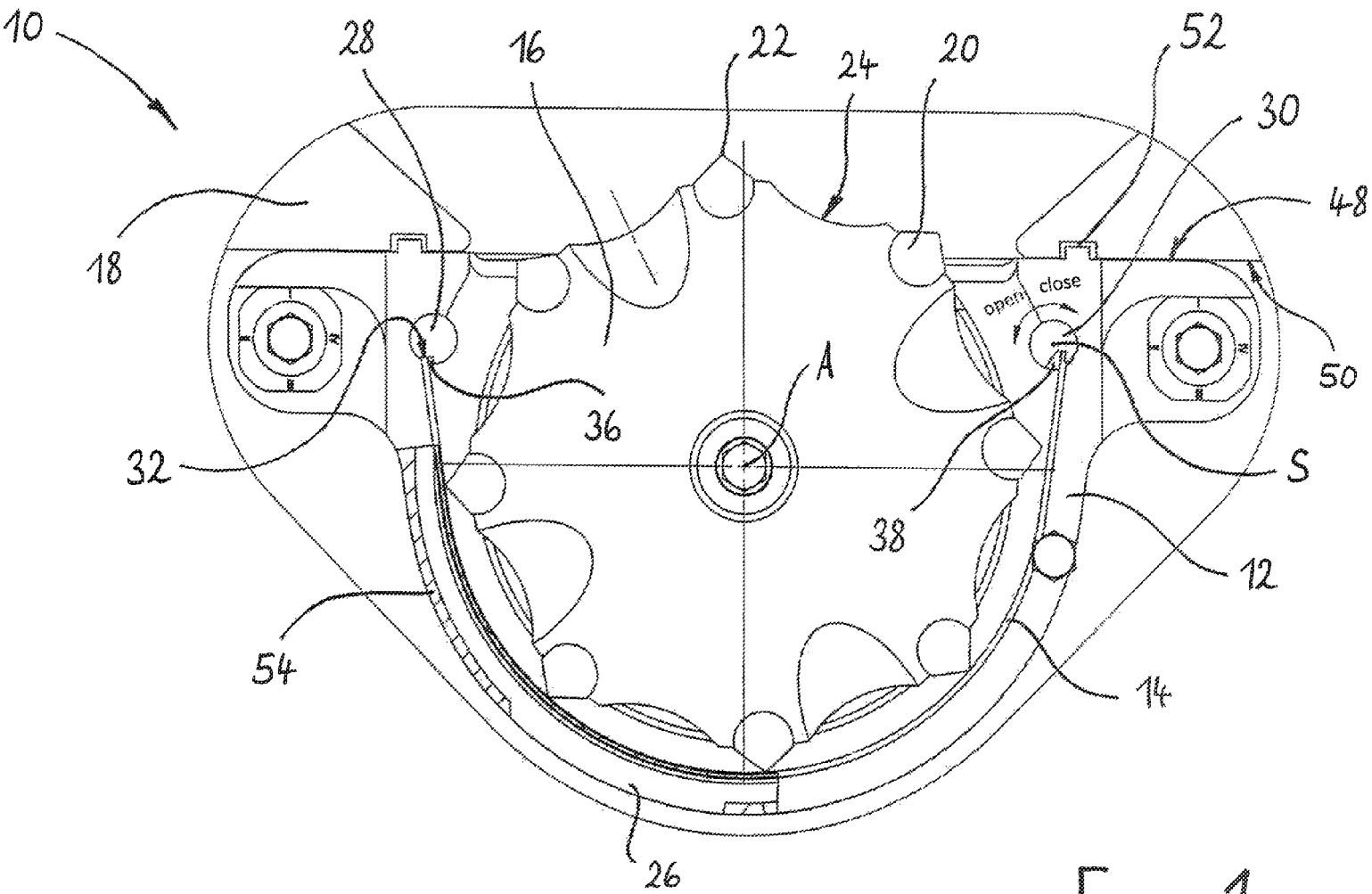

| | | | | |
|---|---|---|---|---|
| 4,151,960 | A * | 5/1979 | Peterson, Jr. | 241/73 |
| 5,975,443 | A | 11/1999 | Hundt et al. | |
| 6,910,647 | B2 * | 6/2005 | Alford et al. | 241/73 |
| 2004/0251347 | A1 | 12/2004 | Sotomayer et al. | |

FOREIGN PATENT DOCUMENTS

| | | | |
|---|---|---|---|
| DE | 161 249 | A3 | 9/1985 |
| DE | 3909427 | C1 | 3/1990 |
| DE | 295 16 988 | U1 | 3/1997 |

* cited by examiner

SIEVE MILL WITH IMPROVED SIEVE RETAINING PROPERTIES

The invention relates to a sieve mill which has a sieve basket having a curved inner side for supporting a sieve which rests on the curved inner side of the sieve basket and has two longitudinal edges which are parallel to and opposite each other, and which furthermore has a material inlet above the sieve and a cylindrical rotor which is arranged such that it can rotate inside the sieve basket.

Sieve mills of the kind mentioned serve to comminute granular products or flakes, such as those created, for example, by a roller press when powdery material passes through the roll gap of the roller press. Customarily, such sieve mills are equipped with a cylinder-segment-shaped sieve basket, in which different sieves can be fitted. In the initial state, these sieves are flat or plane and of rectangular or square shape and by placing them in the sieve basket assume a shape which corresponds to the curved inner side of the sieve basket, e.g. is thus semi-cylindrical or U-shaped. Use is made in particular of rasping sieves, sieves made of wire mesh and sieves made of sheet metal with apertures.

In a conventional sieve mill, the sieve is secured to the sieve basket by means of a clamping bar and screws. To change the sieve, it is necessary to release the screws with the aid of a tool.

The object of the invention is to provide a sieve mill having improved sieve retaining means, in order to be able to carry out a sieve change more quickly.

This object is achieved according to the invention starting from a sieve mill of the kind mentioned at the outset in that one longitudinal edge of the sieve is arranged in a first retaining bar which has a first positioning recess for receiving the one longitudinal edge, and in that the other longitudinal edge of the sieve is arranged in a second retaining bar which has a second positioning recess for receiving the other longitudinal edge, and further in that the second retaining bar can rotate between an open position in which the second positioning recess permits withdrawal and admission of the associated longitudinal edge of the sieve, and a closed position in which the second positioning recess exerts a pressure force on the longitudinal edge arranged in it.

In the sieve mill according to the invention, the sieve is accordingly clamped into the sieve basket exclusively by the two retaining bars, the necessary tension required for the sieve to rest tightly against the sieve basket being built up by means of the clamping which is achieved by the pressure force on the longitudinal edge of the sieve situated in the second positioning recess and the support of the opposite longitudinal edge in the first retaining bar. The clamping securing according to the invention by means of two retaining bars, of which one is rotatable between an open position and a closed position, additionally enables a tool-less and extremely quick change of the sieve, since merely the second retaining bar has to be rotated from its closed position to the open position in order to remove a fitted sieve. In the open position, the second positioning recess frees the longitudinal edge of the sieve received in it, so that the longitudinal edge can be removed laterally, i.e. substantially radially, from the second positioning recess of the second retaining bar. The sieve can then be withdrawn axially in a simple manner from the sieve basket and replaced by another sieve, which is brought into clamping contact with the sieve basket by rotation of the second retaining bar into the closed position.

A further advantage of the tool-less sieve change possible according to the invention is a drastically reduced probability of introduction of foreign particles into the sieve mill, since neither a tool is required for the sieve change nor is it necessary to unscrew and screw in again retaining elements such a screws or the like. The latter advantage cannot be overestimated, especially in the case of sieve mills used in the pharmaceutical industry.

In preferred embodiments of the sieve mill according to the invention, the second retaining bar is rotatable about its central longitudinal axis and the second positioning recess, in particular a pressure surface of the second positioning recess, is arranged eccentrically in the second retaining bar. Owing to the eccentric arrangement of the second positioning recess, upon movement of the second retaining bar from its open position to its closed position a pressure force is built up and transmitted onto the longitudinal edge situated in the second positioning recess. Alternatively, it would also be possible to rotate the second retaining bar about an eccentrically arranged longitudinal axis, in order to produce the desired pressure force.

Preferably, the second positioning recess has an oblique guide surface which starts at the outer circumference of the second retaining bar and continuing inwards ends at a pressure surface which runs at an angle to the guide surface, forms the base of the second positioning recess and in the closed position transmits the pressure force onto the longitudinal edge of the sieve situated in the second positioning recess. The guide surface thus ensures that the edge of the longitudinal edge resting on it in the open position of the second retaining bar is guided to the pressure surface upon movement of the second retaining bar to the closed position, so that the longitudinal edge of the sieve is positioned on the pressure surface to provide the requisite for transmission of the pressure force onto the longitudinal edge. Upon continued rotation of the second retaining bar in the direction of its closed position, the pressure force is then built up and transmitted to the longitudinal edge. Preferably, in this case, the pressure surface is arranged at such an angle to the guide surface that in the closed position the pressure surface rests in a plane manner on the longitudinal edge of the sieve arranged in the second positioning recess. In this way, on the one hand, good force transmission of the generated pressure force is guaranteed and, on the other hand, the longitudinal edge is secured in its position by resting in a plane manner on the pressure surface in the closed position and by the friction resulting therefrom between the said surfaces. The said angle is particularly preferably an obtuse angle.

As an additional safeguard, provision may be made for a stop surface which extends from the wall of the pressure surface opposite the guide surface and, through a form fit, prevents the longitudinal edge of the sieve situated in the second positioning recess from leaving this positioning recess. The stop surface is accordingly arranged such that it is either already in engagement with the outer side of the sieve or comes into engagement with the outer side of the sieve, in the closed position of the second retaining bar, when the longitudinal edge moves sideways outwards, for example due to vibrations.

In preferred exemplary embodiments of the sieve mill according to the invention, at least the second retaining bar has a circular cross-section, which simplifies its rotatable mounting. The first retaining bar too can have a circular cross-section in order to standardise the manufacture.

A movement of the second retaining bar between the open position and the closed position takes place preferably from one end of the second retaining bar, either by means of a corresponding handle or by applying a tool on this end of the retaining bar. The tool can, for example, be a hexagon wrench or an open-end wrench. What is crucial, however, is that, in contrast to a conventional sieve mill, no screws or the like which retain the sieve have to be released and tightened again and that the rotation of the second retaining bar to its closed position and from its closed position can also be effected from outside an isolator or containment in which the sieve mill can be arranged.

In the case of sieve mills of the kind mentioned, the comminution proceeds with the best efficiency when only a small spacing is set between the rotor and the sieve basket or the sieve. Because the wire thickness in course and fine sieve mesh differs, the sieve basket must be height-adjustable in order to maintain the desired small spacing between the rotor and the sieve. A height adjustability of the sieve basket means, however, a changing spacing between the lower side of the material inlet and the upper side of the sieve basket. The gap forming according to the adjustment of the sieve basket is conventionally bridged by baffle plates which prevent material which flows through the material inlet from getting into the gap. These baffle plates are secured by screws, which is undesirable in particular when the sieve mill is operated in completely enclosed form, as is increasingly the case in the pharmaceutical industry.

According to the invention, in order eliminate the said baffle plates, the upper side of the sieve basket and the lower side of the material inlet are formed as plane surfaces, between which a three-dimensional labyrinth seal is arranged. What is meant by this is a labyrinth seal which extends in the length and width direction and also in height, in order, despite a change of the gap size between the upper side of the sieve basket and the lower side of the material inlet—caused by a height adjustment of the sieve basket as previously stated, to prevent a leakage of material at this place. This solution according to the invention, which can be employed on its own or else together with the above-described clamping securing of the sieve, eliminates any screws serving to secure baffle plates, which screws are difficult to clean or may work loose.

When the sieve has a U-shaped cross-section, as already mentioned, then in preferred configurations of the sieve mill according to the invention, the sieve basket is provided, in the region of the limbs of the U-shaped sieve cross-section, with guide plates which guide sieved or ground material downwards to the base of the U-shaped sieve cross-section. Such a solution has the advantage that fines of the ground product which are of poor flowability are guided to the bottom of the U-shaped sieve cross-section and the discharge hopper required there can be narrower, resulting in a reduction in the overall height of the entire apparatus. This constructional solution can also be used on its own or together with one or more of the features according to the invention already described.

Figure 2:
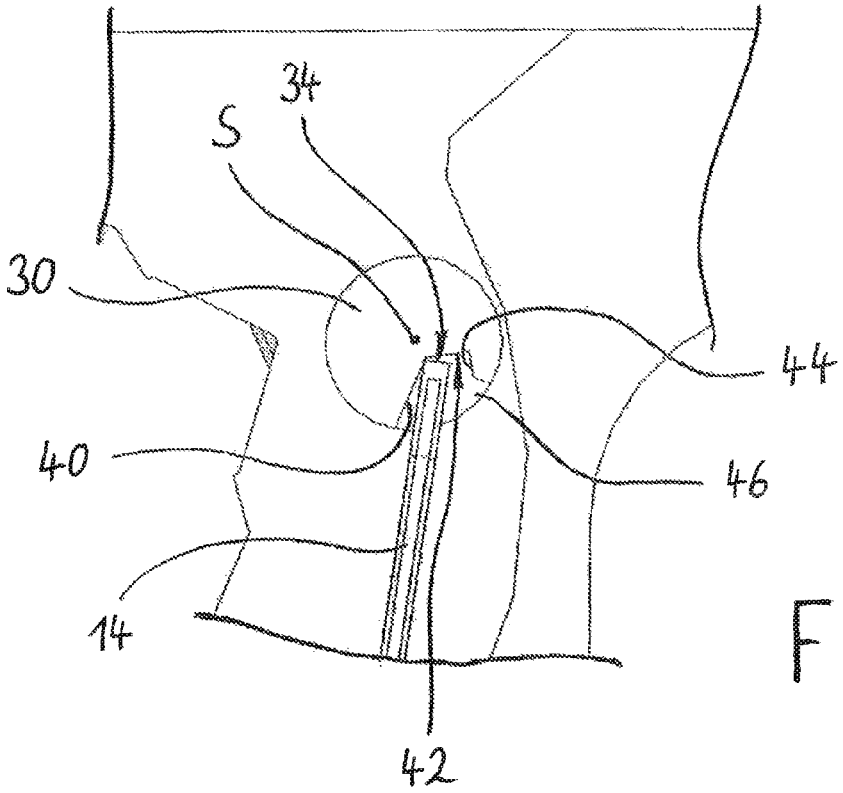
Figure 3:
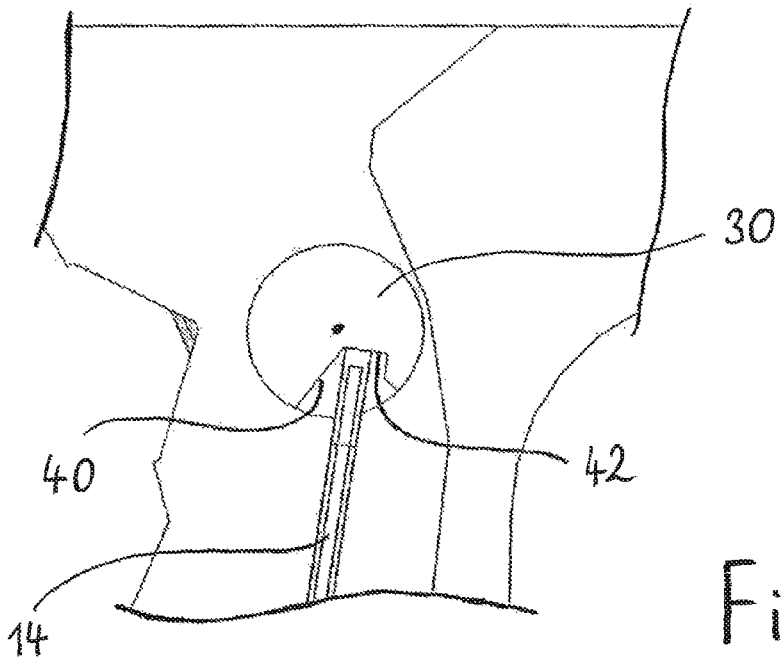

A currently preferred exemplary embodiment of a sieve mill according to the invention is explained in more detail below with reference to the appended, schematic drawing, in which:

FIG. 1 shows a partially sectioned front view of a sieve mill according to the invention, FIG. 2 shows the surroundings of a second retaining bar from FIG. 1 in an enlarged illustration, the second retaining bar being situated in an open position, and FIG. 3 shows an illustration analogous to FIG. 2, the second retaining bar now being situated in a closed position.

Illustrated in FIG. 1 is a sieve mill, denoted generally by 10, the main components of which are a sieve basket 12 for receiving a sieve 14, and a disc-shaped rotor 16 which is arranged inside the sieve basket 12 and the sieve 14 for rotation about an axis A.

The sieve basket 12, which is approximately U-shaped in cross-section, is open at the top, so that material to be comminuted can be fed to it by means of a material inlet 18 of funnel-shaped cross-section, which is arranged on top of the sieve basket 12.

Sieve mills of this kind can serve, for example, to comminute flakes which have been produced from powdery material by means of a roller press. The roller press can be situated directly above the material inlet 18 of the sieve mill 10, in order to form a roller press with integrated sieve mill for conditioning powdery starting material.

As illustrated, the sieve 14, which is flat in the initial state, rests on the U-shape-curved inner side of the sieve basket 12 and is clamped against the inner side of the sieve basket by a device, which will be described more precisely later. In the operation of the sieve mill 10, material flows through the material inlet 18 into the sieve 14 and is moved over the inner sieve surface by the rotating rotor 16. For this purpose, the rotor 16 is provided with a plurality of grinding bars 20, which are distributed uniformly on its circumference, project radially and axially from the rotor 16 and are made of a particularly wear-resistant material. The grinding bars 20, which are secured, here welded, in the rotor 16, have a cross-section which protrudes conically from the rotor surface and ends in a grinding edge 22. Pocket-shaped indentations 24 are formed on the disc-shaped rotor between successive grinding edges 22 in the circumferential direction.

The described form of the rotor 16 results in a, also axially, good distribution of the fed material in the sieve space, the best grinding efficiency being achieved when the grinding edges 22 have only a small spacing from the inner sieve surface. Ground material which has passed through the sieve 14 leaves the sieve mill 10 through a material outlet at 26.

For adaptation to different materials to be processed and product properties desired, but also for maintenance and cleaning, the sieve 14 is removable. To enable this to be done quickly and simply, the illustrated sieve mill 10 has improved sieve retaining means, which is explained in more detail below.

The novel sieve retaining means has retaining bars 28, 30, which are arranged above the sieve basket 12 and run parallel to its upper edges, and of which a first retaining bar 28 is intended for cooperating with one longitudinal edge 32 of the sieve 14 and a second retaining bar 30 rotatable about an axis S is intended for cooperating with the opposite, other longitudinal edge 34 of the sieve 14. For this purpose, the first retaining bar 28 is provided with a first positioning recess 36, which is formed in its surface and extends along the first retaining bar 28, in order to receive the one longitudinal edge 32 of the sieve 14 in a supporting manner therein. In analogous fashion, the second retaining bar 30 is provided with a second positioning recess 38, which serves to receive the other longitudinal edge 34 of the sieve 14, the cross-sectional shape of which recess differs, however, from that of the first positioning recess 36, in order to realise an open position and a closed or clamping position by a rotation of the second retaining bar 30.

FIGS. 2 and 3 show, for better explanation, the second, rotatable retaining bar 30 in an enlarged illustration, FIG. 2 depicting the open position and FIG. 3 the closed position. The second positioning recess 38 comprises an oblique guide surface 40 which starts at the outer circumference of the second retaining bar 30, of circular cross-section in the illustrated exemplary embodiment, continues inwards and ends at a pressure surface 42, which runs at an obtuse angle to the guide surface 40 and forms the base of the second positioning recess 38. It can be seen that, in the open position of the second retaining bar 30, an inner edge of the longitudinal edge 34 of the sieve 14 rests on the guide surface 40. A stop surface 44 extends outwards from the edge of the pressure surface 42 opposite the guide surface 40—in the illustrated exemplary embodiment initially at a right angle to the pressure surface 42—and then its course bends sharply towards the lateral surface of the second retaining bar 30, in order to form an opening 46 for introducing the longitudinal edge 34.

If the second retaining bar 30 is now rotated clockwise about its central longitudinal axis S, starting from the open position depicted in FIG. 2, the inner edge of the longitudinal edge 34 slides down on the guide surface 40 until it runs against the pressure surface 42. A further clockwise rotation of the second retaining bar 30 then causes the entire longitudinal edge 34 to rest against the pressure surface 42, the pressure surface 42, owing to its eccentric arrangement in the second retaining bar 30, exerting simultaneously a pressure force on the longitudinal edge 34, which force is supported via the abutment formed by the first positioning recess 36 in the first retaining bar 28, so that the sieve 14 is pressed against the inner side of the sieve basket 12 and clamped in this position when the second retaining bar 30 has reached its closed position depicted in FIG. 3.

In the closed position, the stop surface 44 may or may not be in engagement with the outer side of the sieve, depending on the width of the longitudinal edge 34, but in any case it prevents the longitudinal edge 34 from slipping out of the second positioning recess 38 unintentionally.

To release the sieve 14 which is firmly clamped in the sieve basket 12, the second retaining bar 30 merely needs to be rotated anticlockwise from the closed position to its open position, in which the sieve 14 is relaxed and can be simply pulled out of the two retaining bars 28 and 30, for example in order to exchange it or clean it.

For adaptation to different sieves 14, the sieve basket 12 is of height-adjustable design, i.e. a spacing between its plane upper side 48 and the plane lower side 50 of the material inlet 18 is variable. In order to prevent material to be processed from escaping through this gap, a three-dimensional labyrinth seal 52 is present, which has a labyrinth of sealing gaps which extend in all three spatial directions and prevent material penetration owing to their flow resistance. The sealing action of the labyrinth seal 52 enables the height adjustment of the sieve basket 12 required for adaptation of the sieve thickness while providing good sealing, without the need for sealing elements, baffle plates or the like which are secured by means of screws.

In order to guide fine material, which has passed through the sieve 14, to the material outlet 26, the sieve basket 12 is provided with guide plates 54 in the region of the limbs of its U-shaped cross-section, i.e. in the steep portions of the cross-section, so that a discharge hopper (not illustrated) only has to be placed in the region of the material outlet 26 and can therefore have a lower overall height.

What is claimed is:

1. A sieve mill, comprising:

a sieve basket having a curved inner side for supporting a sieve which rests on the curved inner side of the sieve basket and has two longitudinal edges which are parallel to and opposite each other;

a material inlet above the sieve; and a cylindrical rotor which is arranged such that it can rotate inside the sieve basket, wherein one longitudinal edge of the sieve is arranged in a first retaining bar which has a first positioning recess for receiving the longitudinal edge, the other longitudinal edge of the sieve is arranged in a second retaining bar which has a second positioning recess for receiving the other longitudinal edge, and wherein the second retaining bar can rotate between an open position in which the second positioning recess permits withdrawal and admission of the associated longitudinal edge of the sieve, and a closed position in which the second positioning recess exerts a pressure force on this longitudinal edge.

2. The sieve mill according to claim 1, wherein the second retaining bar is rotatable about its central longitudinal axis and the second positioning recess is arranged eccentrically in the second retaining bar.

3. The sieve mill according to claim 2, wherein the second positioning recess has an oblique guide surface which starts at the outer circumference of the second retaining bar and continuing inwards ends at a pressure surface which runs at an angle to the guide surface, forms the base of the second positioning recess and in the closed position transmits the pressure force onto the other longitudinal edge of the sieve.

4. The sieve mill according to claim 3, wherein the pressure surface is arranged at such an angle to the guide surface that in the closed position the pressure surface rests in a plane manner on the other longitudinal edge of the sieve.

5. The sieve mill according to claim 3, wherein the angle is an obtuse angle.

6. The sieve mill according to claim 3, wherein a stop surface extends from an edge of the pressure surface opposite the guide surface and is in engagement with an outer side of the sieve in the closed position of the second retaining bar.

7. The sieve mill according to claim 1, wherein at least one of the first retaining bar and the second retaining bar has a circular cross-section.

8. The sieve mill according to claim 1, wherein an upper side of the sieve basket and a lower side of the material inlet are plane surfaces, between which a three-dimensional labyrinth seal is arranged.

9. The sieve mill according to claim 1, wherein the sieve has a U-shaped cross-section.

10. The sieve mill according to claim 9, wherein the sieve basket is provided, in a region of limbs of the U-shaped sieve cross-section, with guide plates which guide sieved material downwards to a base of the U-shaped sieve cross-section.

* * * * *